US009441366B2

(12) United States Patent
Anseth

(10) Patent No.: US 9,441,366 B2
(45) Date of Patent: Sep. 13, 2016

(54) JOIST SUBFRAMING SYSTEMS AND METHODS

(71) Applicant: Jeremy James Anseth, Woodland Hills, CA (US)

(72) Inventor: Jeremy James Anseth, Woodland Hills, CA (US)

( * ) Notice: Subject to any disclaimer, the term of this patent is extended or adjusted under 35 U.S.C. 154(b) by 0 days.

(21) Appl. No.: 14/567,666

(22) Filed: Dec. 11, 2014

(65) Prior Publication Data

US 2016/0168850 A1 Jun. 16, 2016

(51) Int. Cl.

| | |
|---|---|
| ***E04H 12/18*** | (2006.01) |
| ***E04B 5/10*** | (2006.01) |
| ***E04B 1/41*** | (2006.01) |
| ***E04C 3/00*** | (2006.01) |
| ***E04C 3/07*** | (2006.01) |
| *E04C 3/04* | (2006.01) |

(52) U.S. Cl.
CPC . *E04B 5/10* (2013.01); *E04B 1/40* (2013.01); *E04C 3/005* (2013.01); *E04C 3/07* (2013.01); *E04C 2003/0473* (2013.01)

(58) Field of Classification Search
CPC .... E04B 5/10; E04B 1/40; E04B 2003/0473; E04C 3/005; E04C 3/07
USPC ..... 52/645, 646, 126.1, 126.5, 126.6
See application file for complete search history.

(56) References Cited

U.S. PATENT DOCUMENTS 4,581,863 A * 4/1986 Thaler ..... E04D 13/1407 248/354.3
4,637,181 A * 1/1987 Cohen ..... E04F 15/02452 52/126.5
5,150,557 A * 9/1992 Gregory ..... E04G 11/48 248/352
5,564,235 A * 10/1996 Butler ..... E02D 27/00 16/260
6,332,292 B1 12/2001 Buzon
6,397,539 B1 * 6/2002 Kimura ..... E04B 5/04 52/126.6
6,669,163 B2 * 12/2003 Davis, Jr. ..... F16M 7/00 248/188.1
6,772,564 B2 * 8/2004 Leon ..... E04F 15/024 52/126.5
8,256,175 B2 9/2012 Buzon
8,966,855 B1 * 3/2015 Miller ..... E04B 5/14 52/650.3
2004/0261329 A1 * 12/2004 Kugler ..... E04F 15/02183 52/126.6
2005/0252161 A1 * 11/2005 Hovey ..... E04B 1/24 52/837
2010/0031587 A1 * 2/2010 Weeks ..... E02D 27/14 52/126.6
2010/0043329 A1 * 2/2010 Dagg ..... E04B 1/24 52/414
2011/0088336 A1 * 4/2011 Larsen, Jr. ..... E04G 23/06 52/126.1

* cited by examiner

*Primary Examiner* — Mark Wendell
(74) *Attorney, Agent, or Firm* — Mohr Intellectual Property Law Solutions, PC

(57) ABSTRACT

Joist subframe systems including vertically arranged support members each having adjustable height securing members coupled with the support member in a fixed position and horizontally arranged elongate frame members configured to support one or more overlying surface members and shown and described. Each of the elongate frame members including an elongate body with at least one horizontal wall and one or more support member attachment mechanisms configured to couple one of the support members to the elongate body. In some examples, the adjustable height securing members are selectively tightenable and loosenable to the support members for adjustable coupling to the support member and to releasably fix a position of the support member to one of the plurality of elongate frame members.

18 Claims, 12 Drawing Sheets

JOIST SUBFRAMING SYSTEMS AND METHODS

BACKGROUND

The present disclosure relates generally to joist subframing systems. In particular, joist subframing systems including horizontally arranged elongate frame members (i.e., joist members) each being adjustably attached to vertically arranged support members are shown and described.

Joist subframing systems include horizontal supporting members that run between foundations, walls, and/or beams to support an overlying structure (e.g., an exterior deck, an interior floor, etc.). Known joist subframing systems are not entirely satisfactory for the range of applications in which they are employed. For example, existing joist frames are comprised of wood joist beams that can have a high weight and profile of the joist frame, and are subject to decay, rot, and/or insect infestation. In an additional example, conventional joist subframes cannot be easily adjusted for a desired height of a surface and/or to create a level surface (e.g., floor) over an uneven and/or angled underlying surface. In even another example, some joist systems cannot be used in combination with underlying waterproofing systems and/or can tear/puncture an underlying waterproofing system. In this example, water may collect under the joist subframe and cause damage to a foundation and/or other adjacent structures.

Thus, there exists a need for joist subframing systems and methods that improve upon and advance the design of known joist subframing systems. Examples of new and useful joist subframing systems relevant to the needs existing in the field are discussed below.

Disclosure addressing one or more of the identified existing needs is provided in the detailed description below. Examples of references relevant to joist subframing systems include U.S. Patent References: U.S. Pat. No. 6,332,292 and U.S. Pat. No. 8,256,175. The complete disclosures of the above patents and patent applications are herein incorporated by reference for all purposes.

SUMMARY

The present disclosure is directed to a joist subframe system including vertically arranged support members each having adjustable height securing members coupled with the support member in a fixed position and horizontally arranged elongate frame members configured to support one or more overlying surface members. Each of the elongate frame members including an elongate body with at least one horizontal wall and one or more support member attachment mechanisms configured to couple one of the support members to the elongate body. In some examples, the adjustable height securing members are selectively tightenable and loosenable to the support members for adjustable coupling to the support member and to releasably fix a position of the support member to one of the plurality of elongate frame members.

DETAILED DESCRIPTION

Figure 1:
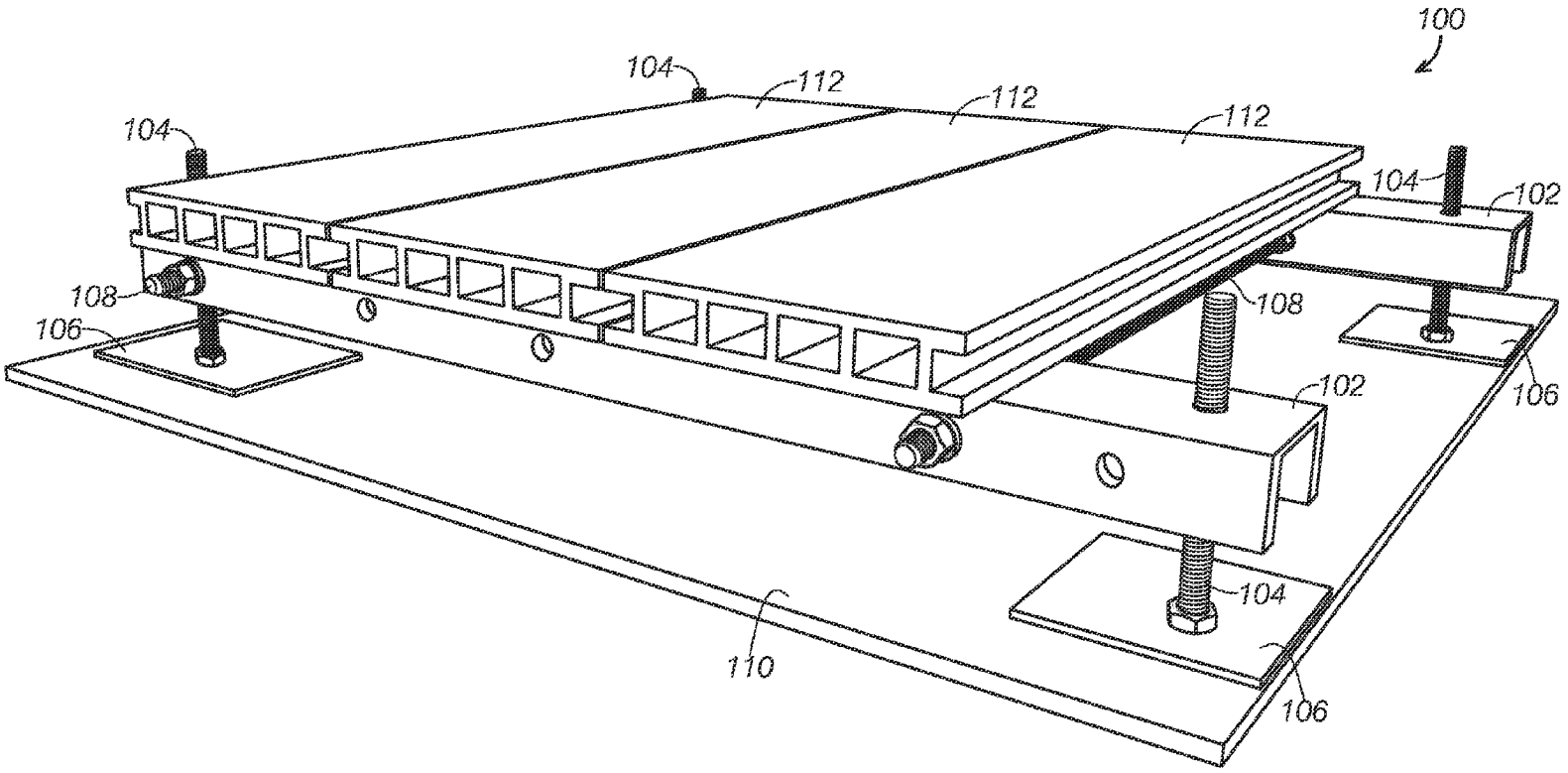
FIG. 1 is a perspective view of a first example of a joist subframing system with overlying surface members.

The disclosed joist subframing systems and methods will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, examples of various joist subframing systems and methods are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

With reference to FIGS. 1-12, a first example of a joist subframing system, joist system 100 will now be described. Joist system 100 includes elongate frame members 102, support members 104, foot members 106, and fastening members 108. Joist system 100 is disposed between an underlying surface 110 (e.g., a ground surface, a foundation surface, etc.) and an overlying surface members 112. Elongate frame members 102 are metallic frame members (e.g., aluminum elongate frame members) that include attachment mechanisms for support members and the height of the elongate member on the support member can be selectively adjusted. Accordingly, joist system 100 functions to support an overlying floor surface. Additionally or alternatively, joist system 100 can be used to support a ceiling and/or roof surface.

Joist system 100 addresses many of the issues and problems that occur with conventional joist subframes. For example, the elongate frame members are comprised of a metallic material that is not subject to insects, rot, and decay. In another example, as attachment mechanisms are built into the elongate frame members, joist subframe system 100 has an overall lower profile and heights of the elongate frame members are easily adjusted and/or leveled to create a level overlying surface. In even another example, joist subframe system 100 can be used in combination with multiple types of underlying water proofing layers.

Figure 2:
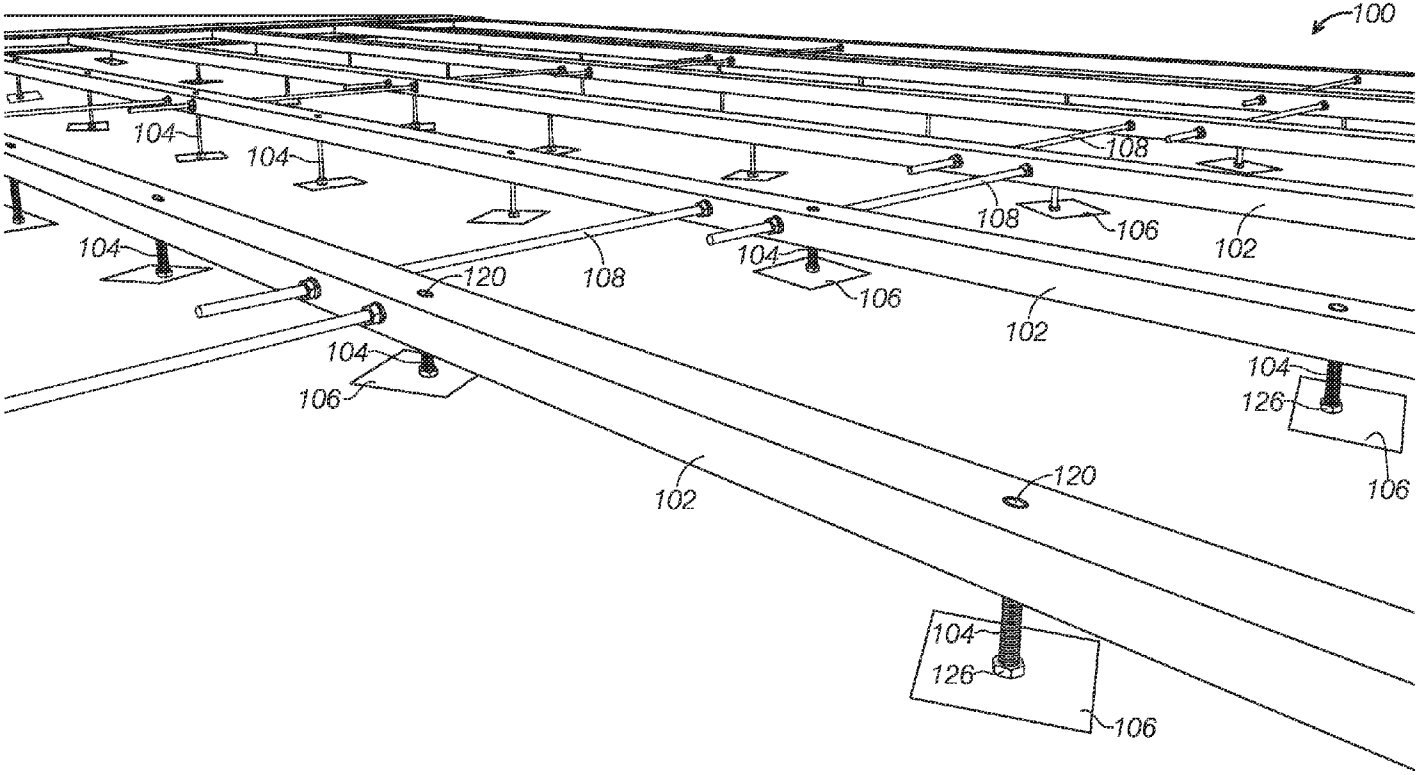
FIG. 2 is a perspective view of the first example of a joist subframing system shown in FIG. 1 depicting the joist subframe without the overlying flooring beams.
Figure 3:
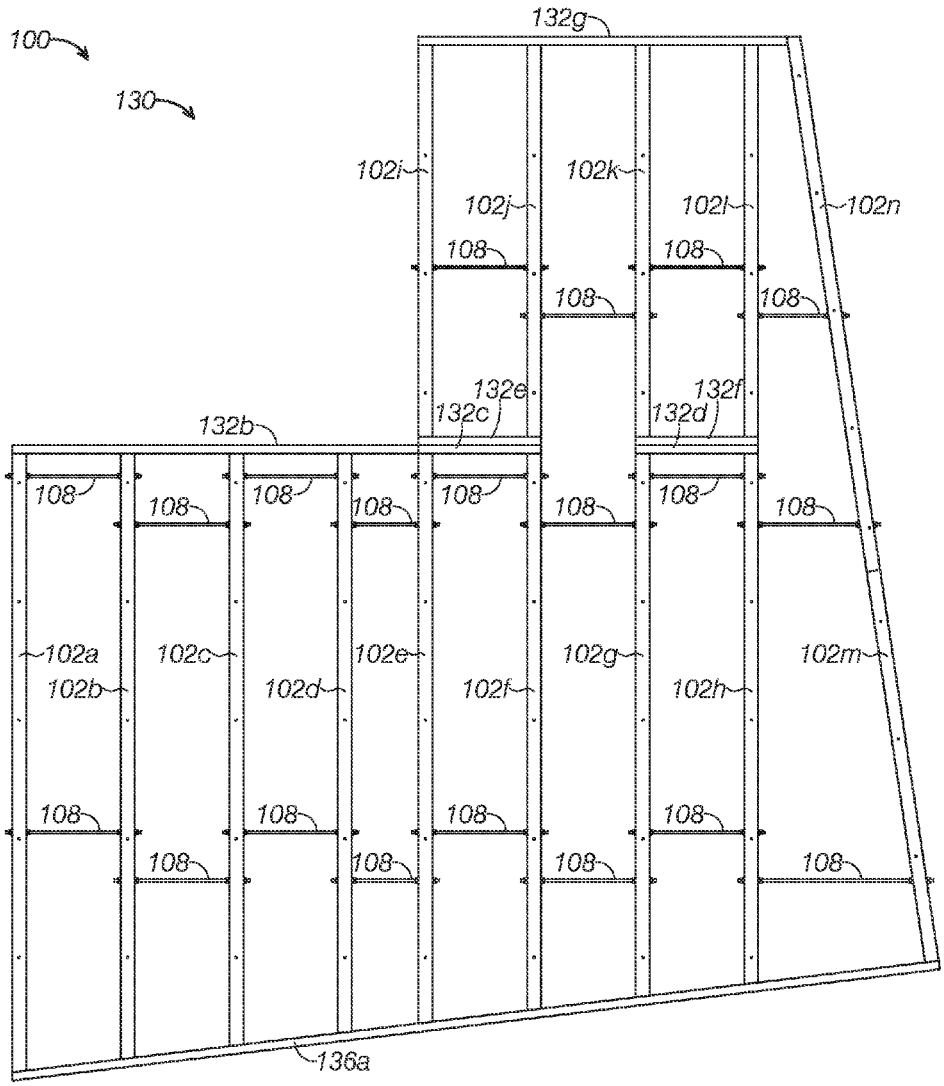
FIG. 3 is a top plan view of the first example of a joist subframing system shown in FIG. 1, showing one example configuration tor the joist subframe.

As can be seen in FIGS. 1-3, each, of elongate frame members 102 are horizontally arranged. Further, most of elongate frame members 102 are generally parallel and equally spaced relative to adjacent elongate frame members. It will be appreciated that joist subframe system 100 can be used to create a desired configuration for a floor. FIG. 3 shows one example arrangement/configuration 130 for a joist subframe.

In the example of FIG. 3, elongate frame members 102*a*-102*h* are parallel to each other and elongate frame members 102*i*-102*l* are parallel to each other, while elongate member 102*m* is disposed at an angle relative to elongate frame members 102*a*-102*h* and elongate member 102*n* is disposed at an angle relative to elongate frame members 102*i*-102*l*. Further, some elongate frame members (e.g., 102*e* and 102*i*, 102*f* and 102*j*, 102*g* and 102*k*, 102*h* and 102*l*, 102*m* and 102*n*) are in a linear configuration, and are substantially continuous in arrangement/configuration 130. Parallel elongate frame members (102*a*-102*h* and 102*i*-102*l*) and elongate frame members disposed at an angle relative to parallel elongate frame members (102*m* and 102*n*) are joined by horizontally arranged fastening members 108.

Figure 4:
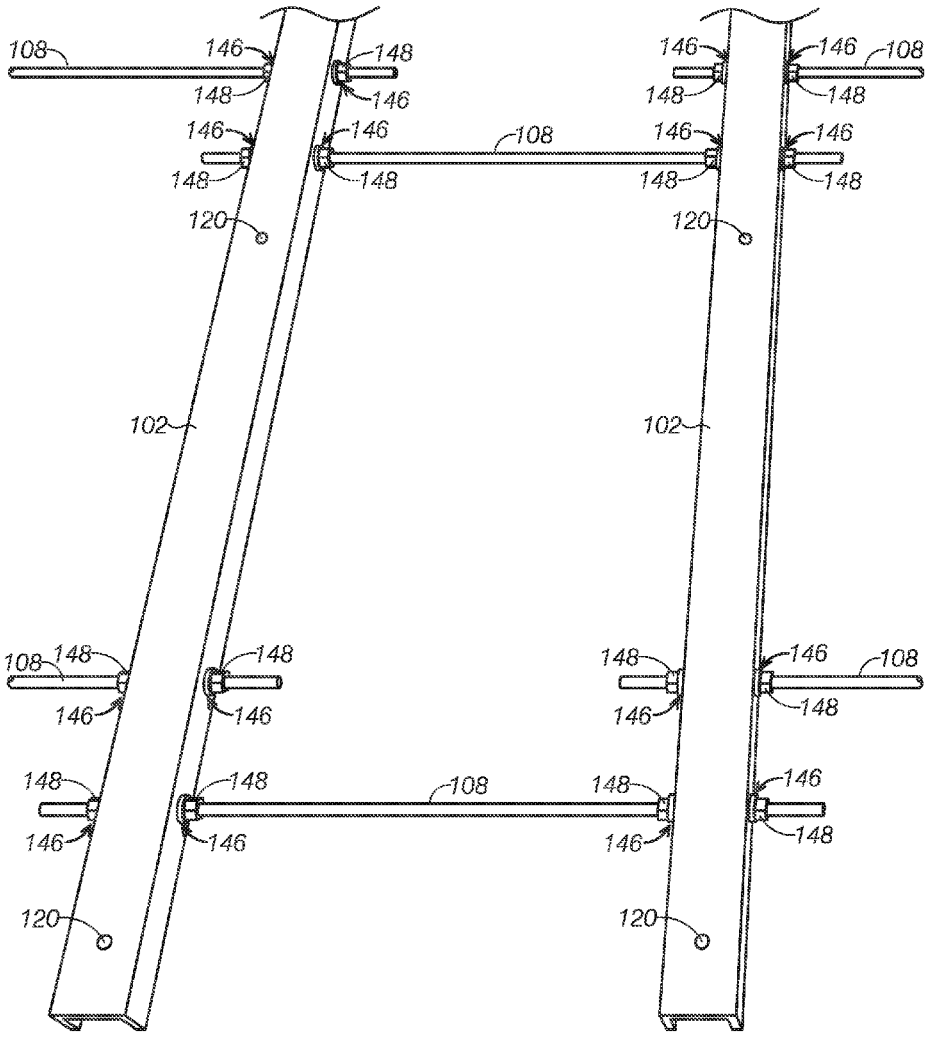
FIG. 4 is a top plan view of a portion of the first example of a joist subframing system shown in FIG. 1 depicting horizontally arranged securing members.

As depicted in FIG. 4, fastening members 108 are inserted through holes 146 in each of elongate frame members 102. A first end of each fastening member 108 is attached to one elongate frame member 102 and a second end of the fastening member 108 is attached to an adjacent elongate frame member 102. A position of each of fastening members 108 is releasably fixed by coupling and/or attachment of a securing member 148 to the fastening member on each of a first side and a second side of an associated elongate frame member 108. Fastening members 108 are attached to vertical walls of the elongate frame members.

In the present example, fastening members 108 are threaded members and securing members 148 are nuts that are complimentarily configured to the threaded members. Further, a washer can be disposed between securing member 148 and a wall of the elongate frame member. In one specific example, the fastening members, the nuts, and the washers are ⅜" stainless steel. In alternate examples, one or more of the fastening members and the securing members can have a different configuration. In one specific alternate example, the fastening members can be non-threaded members and the securing members can be releasable clamping members.

Returning to FIG. 3, in some examples only one fastening member 108 is used to join adjacent elongate frame members (e.g., elongate frame members 102*i*-102*l*). In other examples, two fastening members 108 are used to join adjacent fastening members (e.g., elongate frame members 102*a*-102*h*). It will be appreciated that more or fewer fastening members can be used to attach adjacent elongate frame members. It will be further appreciated that fastening member can be of equal length to accommodate elongate frame members that are parallel relative to adjacent elongate frame members (e.g., fastening members 108 attached between elongate frame members 102*a*-102*d*) and/or fastening members can be of different lengths to accommodate elongate frame members disposed at an angle relative to adjacent elongate frame members (e.g., fastening members attached between elongate frame members 102*h* and 102*m*).

As depicted in FIG. 3, joist system 100 further includes capping members 132 (e.g., 132*a*-132*f*). Capping members can be square tubes comprised of a metallic material, such as aluminum or steel. Capping members can be any desired length that is necessary to "cap" an ends of elongate frame members 102 and are generally perpendicular relative to the elongate frame members. In one specific example, capping members are 25'×1¼"×1¼" aluminum square members that can be cut to a desired length using a blade, such as a carbide blade.

In the present example configuration, capping member 132*a* is a longer capping member that caps a first end of elongate frame members 102*a*-102*h* and 102*m*, capping member 132*b* is a shorter capping member that caps a second opposing end of elongate frame members 102*a*-102*d* and capping members 132*c* and 132*d* are even shorter capping members that cap a second opposing end of elongate frame members 102*e* and 102*f*, and 102*g* and 102*h*, respectively.

Capping members 132*e* and 132*f* are of a substantially equal length relative to capping members 132*c* and 132*d*. Capping member 132*e* caps a first end of elongate frame members 102*i* and 102*j*, while capping member 132*f* caps a first end of elongate members 102*k* and 102*l*. A second opposing end of elongate frame members 102*i*-102*l* and 102*n* are capped by a capping member 132*g*, which is of a substantially equal length relative to capping member 132*b*. Longitudinal faces of capping members 132*c* and 132*e*, and 132*d* and 132*f* can be attached via attachment members and/or an adhesive (not specifically shown).

In alternate examples, a single capping member can be used to cap a second end of an elongate frame member and a first end of a linearly aligned other elongate frame member. In other words, capping member 132*c* could be a capping member for second ends of elongate frame members 102*e* and 102*f* and first ends of elongate frame members 102*i* and 102*j*. In even other alternate examples, capping members can be excluded from joist system 100.

Figure 5:
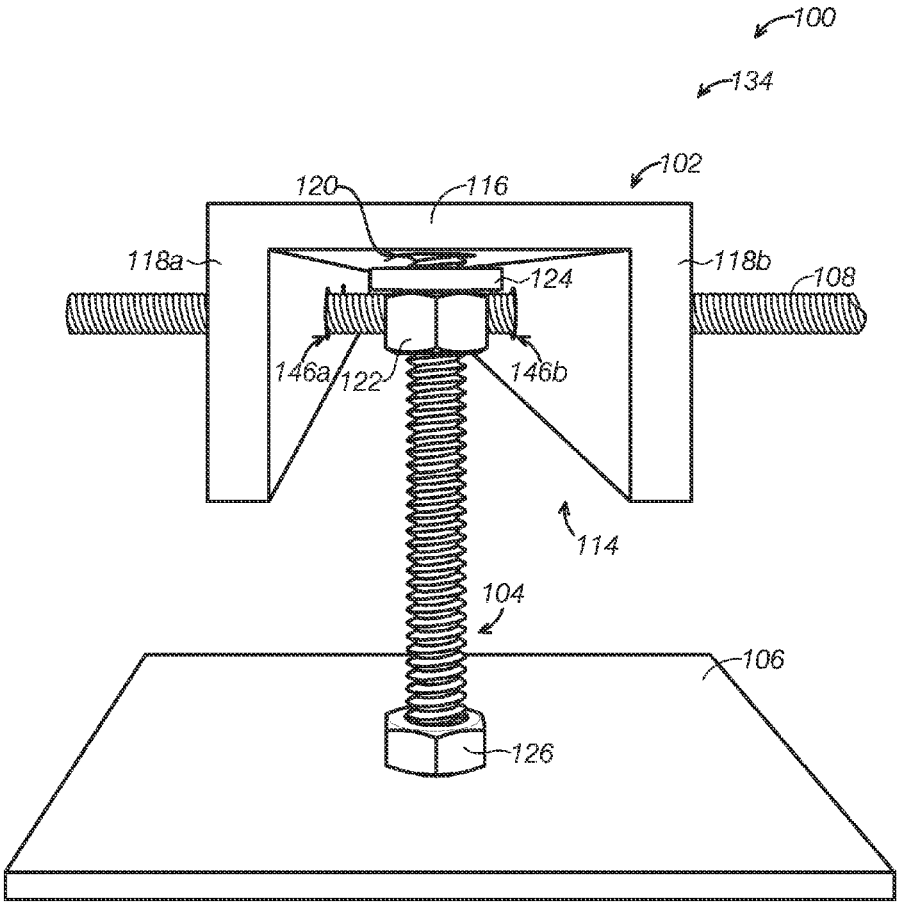
FIG. 5 is a longitudinal perspective view of the first example of a joist subframing system shown in FIG. 1 depicting a first example configuration for the elongate frame member and a first example foot member.
Figure 6:
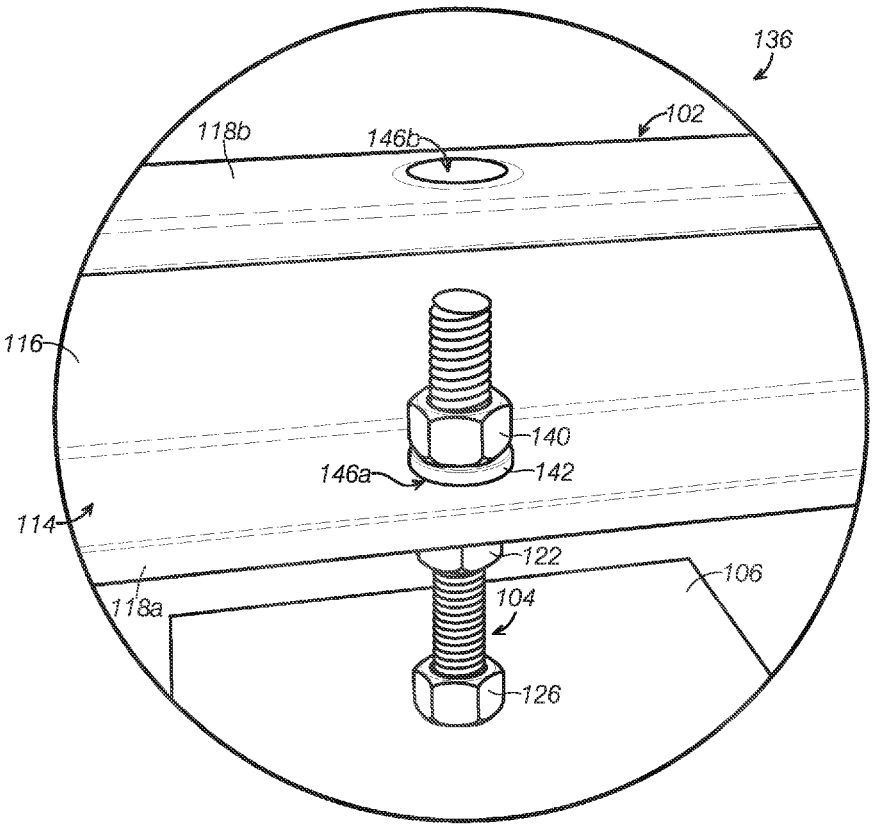
FIG. 6 is a perspective view of the first example of a joist subframing system shown in FIG. 1 depicting a second example configuration for the elongate frame member and the first example foot member.

Turning attention to FIGS. 5 and 6, in the present example, die elongate frame members are each "C" channel elongate frame members comprised of a metallic material. In one specific example, the "C" channel elongate frame members are 25'×1¼"×2" aluminum joists. The elongate frame members can be cut to a desired length using a blade, such as a carbide blade.

As shown in FIG. 5, in a first example orientation 134, the "C" channel elongate frame members are oriented so that an open side 114 is faced downward (i.e., faced toward an underlying ground surface). Accordingly, in the configuration shown in FIG. 5, each elongate frame member 102 includes a central wall 116 with two side walls 118 (i.e., 118*a* and 118*b*) extended downwardly from opposing ends of central wall 116. In this example, central wall 116 is a horizontal central top wall and side walls 118 are vertical side walls. As described above in reference to FIG. 4, fastening member 108 is inserted through holes 146 (i.e., holes 146*a* and 146*b*) in the side walls 118 (i.e., side walls 118*a* and 118*b*, respectively) of elongate frame member 102.

Central wall 116 includes receiving holes 120 for coupling elongate frame members 102 to support members 104. As shown in FIG. 5, support members 104 are threaded members configured to be inserted through holes 120. Therefore, the through holes are a support member attachment mechanism configured to couple one of the support members to the elongate body of the elongate frame members. Each of adjustable height securing members 122 are positionally adjustable and coupled to one of support members 104 in order to releasably fix a position of the support member and the elongate frame member. In other words, the adjustable height securing members are selectively tightenable and loosenable to one of the support members to releasably fix a height of coupling of the elongate frame member to the support member.

In the present example, securing members 122 are nuts that are complimentarily configured to the threaded members and one of washers 124 (e.g., a lock washer) are disposed between securing member 122 and central wall 116. In one specific example, the support member, the securing members, and the washers are ⅜" stainless steel. In alternate examples, one or more of the support members and the adjustable height securing members can have a different configuration. In one specific alternate example, the support members can be non-threaded members and the adjustable height securing members can be releasable clamping members.

Looking now at FIG. 6, a second example orientation 136 for the "C" channel elongate frame members will now be described. Second example orientation 136 includes many similar or identical features to configuration 134. Thus, for the sake of brevity, each feature of orientation 136 will not be redundantly explained. Rather, key distinctions between orientations 136 and 134 will be described in detail and the reader should reference the discussion above for features substantially similar between the two orientations.

As shown in FIG. 6, in second example orientation 136, "C" channel elongate frame members are oriented so that open side 114 is faced to a side (i.e., faced toward perpendicular to an underlying ground surface). Accordingly, in the configuration shown in FIG. 6, each elongate frame member 102 includes a central wall 116 with two horizontal side walls 118 extended to parallel to an underlying ground surface away from opposing ends of central wall 116. In this example, central wall 116 is a vertical central side wall, side wall 118*a* is a bottom horizontal wall, and side wall 118*b* is a top horizontal waill.

Central wall 116 includes receiving holes 138*a* for coupling elongate frame members 102 to support members 104. As shown in FIG. 6, support members 104 are threaded members configured to be inserted through holes 138*a*. Therefore, the through holes are a support member attachment mechanism configured to couple one of the support members to the elongate body of the elongate frame members. Each of adjustable height securing members 122 are positionally adjustable and coupled to one of support members 104 to releasably fix a position of the support member and the elongate frame member. Further, adjustable height securing member 122 is a bottom side securing member (i.e., securing member 122 is secured on bottom of central wall 116).

In the present example, adjustable height securing members 122 are nuts that are complimentarily configured to the threaded members and one of washers 124 are disposed between securing member 122 and side wall 118*a*. In one specific example, the support member, the securing members, and the washers are ⅜" stainless steel. In alternate examples, one or more of the support members and the adjustable height securing members can have a different configuration. In one specific alternate example, the support members can be non-threaded members and the adjustable height securing members can be releasable clamping members.

Differently from first example configuration 134, example configuration 136 includes a second securing member 140, which is a top side securing member (i.e., securing member 140 is secured on a top side of wall 118*a*). Similar to securing member 122, each of securing members 140 are positionally adjustable and coupled to one of support members 104 to assist in releasably fixing a position of the support member and the elongate frame member.

In the present example, securing members 140 are nuts that are complimentarily configured to the threaded members and one of washers 142 are disposed between securing member 140 and side wall 118*a*. In alternate examples, one or more of the support members and the securing members can have a different configuration. In one specific example, the support members can be non-threaded members and the securing members can be releasable clamping members. In even other alternate examples, the joist system can exclude the top side securing member. Although not specifically shown, it will be appreciated that fastening members 108 can be inserted through and attached to the elongate frame members via holes 120.

Figure 7:
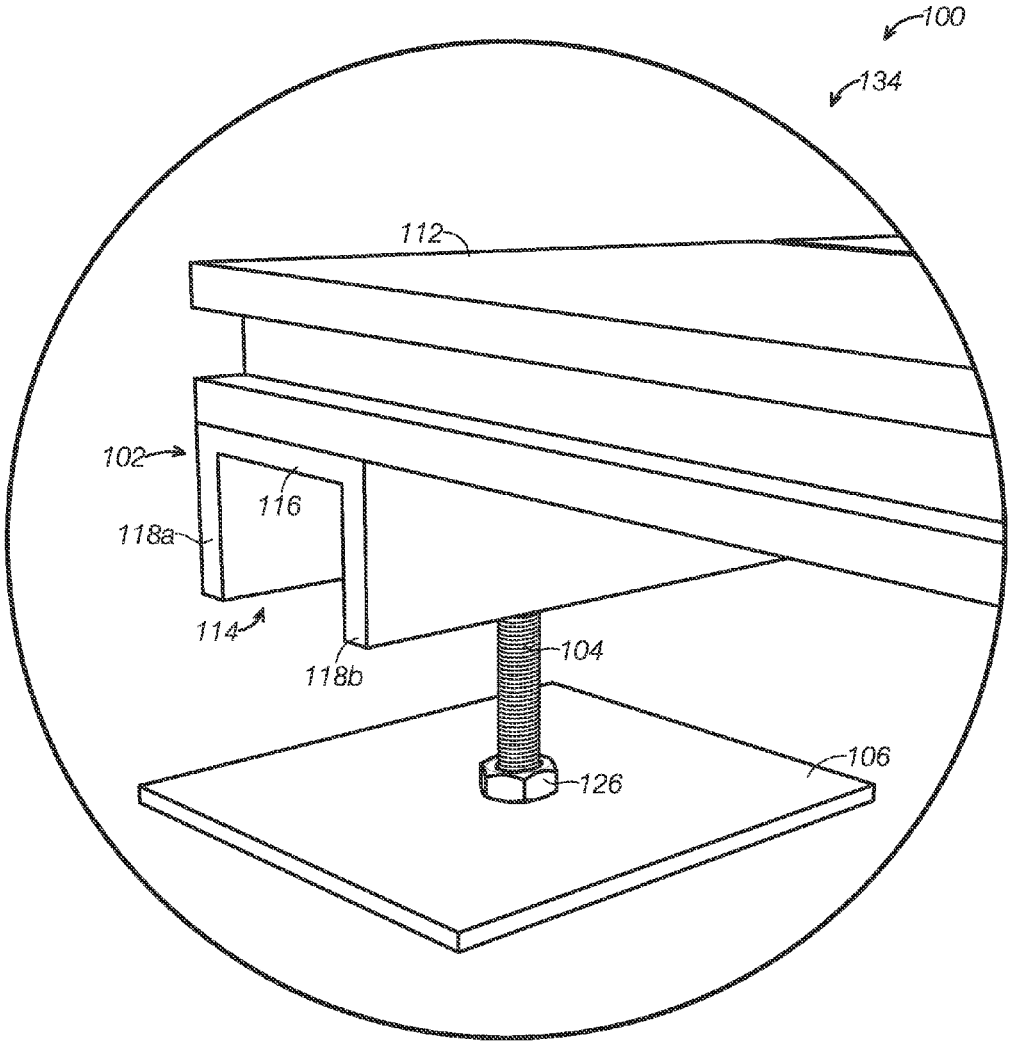
FIG. 7 is a perspective view of the first example of a joist subframing system shown in FIG. 1 depicting the elongate frame member in the first example configuration with an associated overlying surface member.
Figure 8:
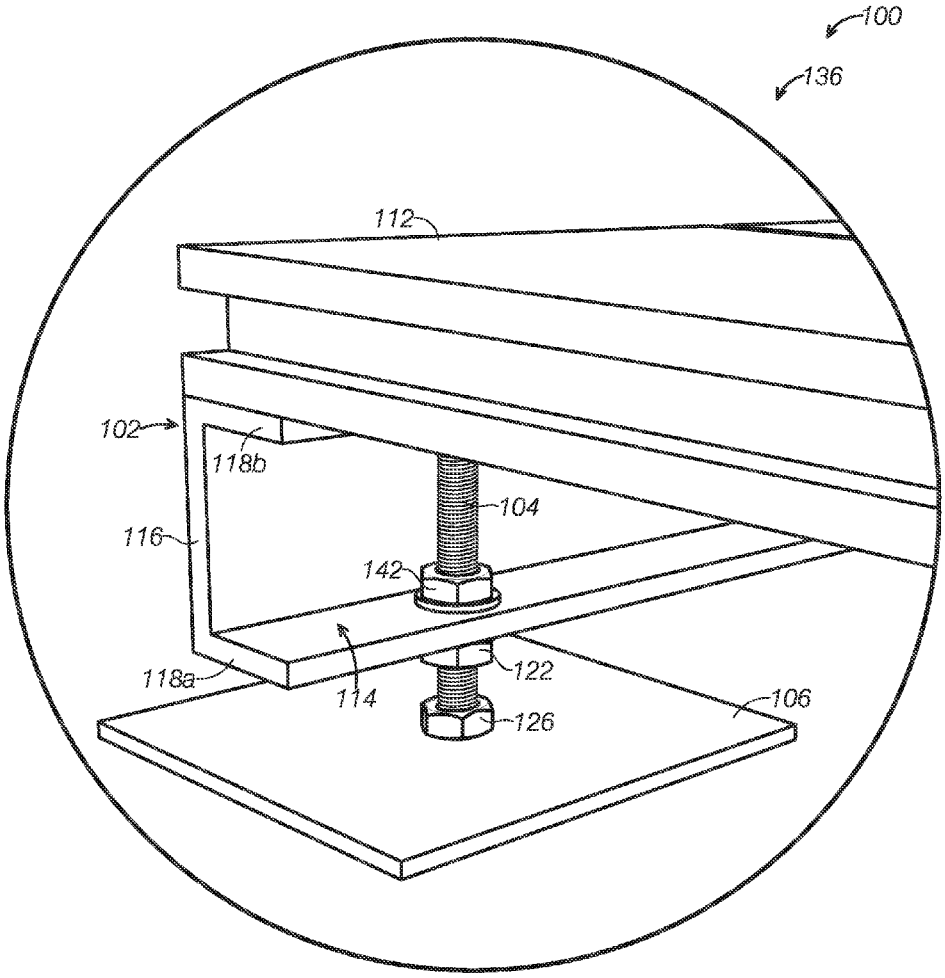
FIG. 8 is a perspective view of the first example of a joist subframing system shown in FIG. 1 depicting the elongate frame member in the second example configuration with an associated overlying surface member.

FIGS. 7 and 8 show elongate members 102 in configurations 134 and 136, respectively, supporting overlying surface members 112. As depicted in FIG. 7, in configuration 134, central wall 116 is abutted to and supports overlying surface member 112. Alternatively, as depicted in FIG. 8, in configuration 136, side wall 118*b* is abutted to and supports overlying surface member 112. It will be appreciated that in the second example configuration (where the central wall is a vertical wall) either of side wall 118*a* or 118*b* can be a top wall and be abutted to and support the overlying surface member.

In one example, when joist frames at adjoining horizontal surfaces require substrates less than 1¼", the first example orientation (i.e., first example orientation 134 shown in FIGS. 1-5, 7, and 10) for the elongate frame members can be advantageous due to the low profile design thereby accommodating surrounding height restrictions. Alternatively, in another example where the joist subframe is applied over a primary substrate (e.g., poured concrete slab on grade) and penetrations to the substrate are possible, the second example orientation (i.e., second example orientation 136 shown in FIGS. 6, 8, 9, 11, and 12) position of the elongate frame members coupled with embedded supports provides an increased rigid platform, reducing flex between the adjustable supports due to its configuration. Accordingly, in this example, the second example orientation 136 may be advantageous.

As shown in FIGS. 5-8, an opposing end of each of support: members (i.e., a bottom end of each of the support members) includes a bolt head 126. Bolt head 126 is abutted to foot member 106. In the present example, foot member 106 is a rectangular sheet comprised of a metallic material, such as steel, aluminum, etc. In other examples, the foot member can be comprised of a non-metallic material, such as rubber, cork, etc. Foot member 106 distributes the pressure and/or weight of the support member and the elongate frame member over a wider surface area than the surface area of the bolt head 126. Accordingly, the foot member can be used to prevent penetration of the support member into one or more of an underlying water proofing layer and an underlying surface. In other words, foot member is configured to cushion the bottom end of the support member against the underlying surface. The foot members are "distribution pads".

Figure 9:
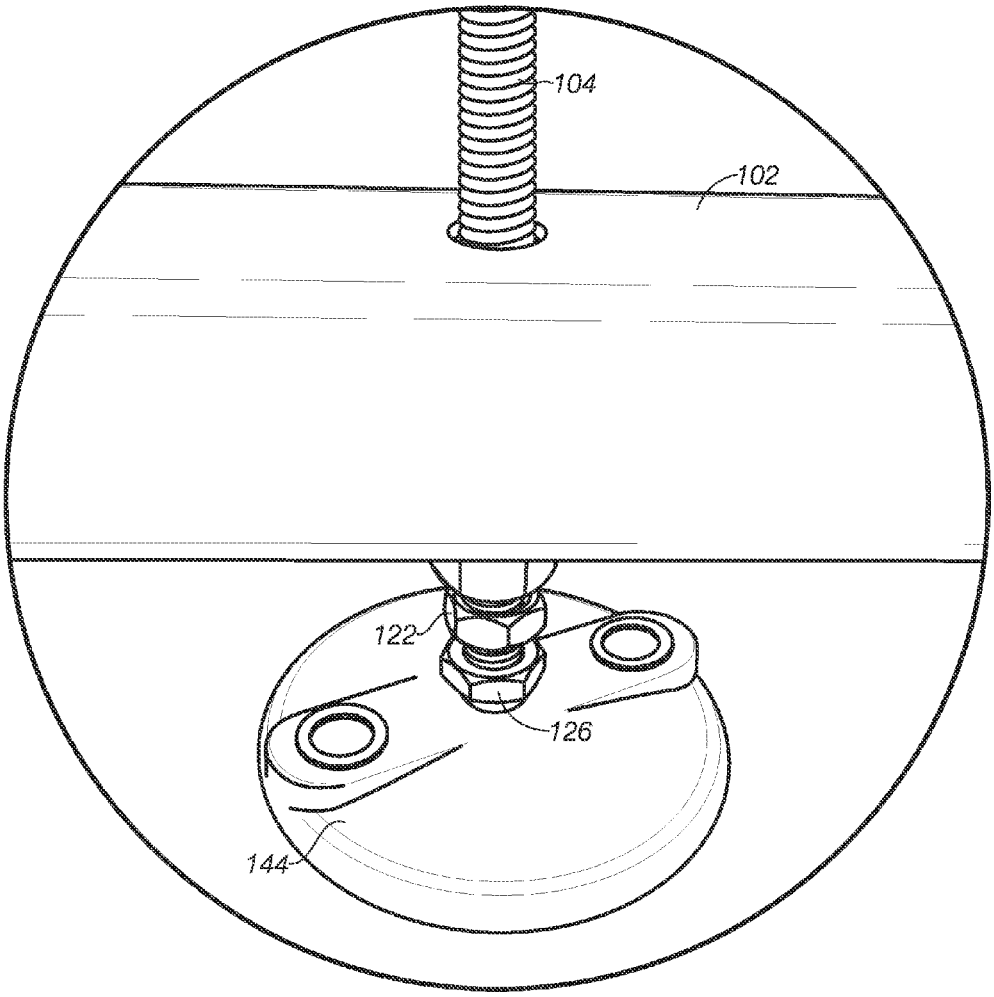
FIG. 9 is a perspective view of the first example of a joist subframing system shown in FIG. 1 depicting the elongate frame member in the second example configuration with a second example foot member.

Additionally or alternatively, bolt head 126 can be abutted to or coupled with a leveling mount, such as leveling mount 144 shown in FIG. 9. Leveling mount 144 can be comprised of rubber or a metallic material. A variety of leveling mounts can be used in combination with joist system 100, such as those described in U.S. Pat. No. 6,910,666 and U.S. Pat. No. 6,742,750. Further, suitable leveling mounts can include those from available from McMaster-Carr® (e.g., leveling mounts, ultra-high capacity leveling mounts, swivel leveling mounts, stainless steel swivel leveling mounts, bolt down swivel leveling mounts, low -profile swivel leveling mounts, high-capacity acme threaded swivel leveling mounts, etc.). In alternate examples, the support member can exclude the bolt head and can be used in combination with leveling mounts having threaded holes. For example, suitable leveling mounts having threaded holes can include those from McMaster-Carr® (e.g., swivel leveling mounts with threaded holes, bolt-down swivel leveling mounts with threaded holes, etc.).

Figure 10:
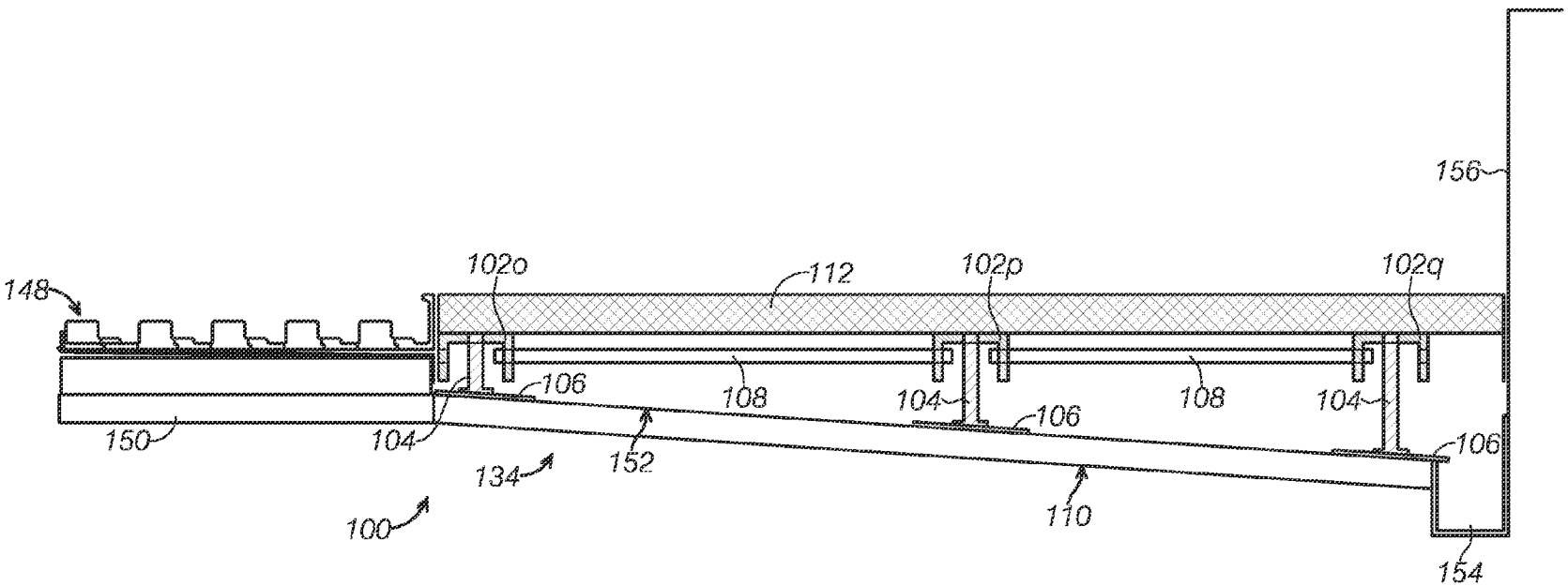
FIG. 10 is a side elevation view of the first example of a joist subframing system shown in FIG. 1 depicting associated overlying surface members and a first example underlying water proofing system.

Turning now to FIG. 10, joist system 100 is shown in combination with a door threshold 148, deck sheeting 150, a waterproof membrane 152, a perimeter drain 154, and a stem wall 156. In the example of FIG. 10, elongate frame members 102 are in configuration/orientation 134 (shown in FIG. 5 and described above). Accordingly, the central wall of each elongate frame member supports overlying surface members 112. It will be appreciated that in alternate examples the elongate members can instead be in configuration/orientation 136 (shown in FIG. 6 and described above). Further, in this example, overlying surface members 112 comprise a deck surface.

Overlying surface members 112 have a level configuration over an inclined ground surface 110. In order to create the level overlying surface, an elongate frame member 102*o* is fixed/secured at a shorter height over a higher point in the surface, an elongate frame member 102*p* is fixed/secured at a median height at a median point in the surface, and an elongate frame member 102*q* is fixed/secured at a higher height at a lower point in the surface. It will be appreciated that more or fewer elongate members fixed at level heights corresponding to their location on the inclined surface can be used to support the overlying surface members.

As shown in FIG. 10, joist system 100 and overlying surface members 112 (e.g., Resysta®, Trex®, Timber Tech®, Fiberon®, Tile and Stone, etc.), are aligned with the horizontal plane of door threshold 148 (e.g., Fleetwood, Pella®, Andersen®, Milgard®, etc.). Used as primary deck framing, joist system 100 allows for easy and secure adjustments to create a level finished surface over a multiple angle substrate and/or waterproofing membrane (e.g., Desotex®, Semco®, Tremco®, Shluter®, etc.). This configuration allows a level surface by use of the joist framing system adjusted over an uneven and/or unlevel ground surface without penetrating in the waterproofing membrane below. Moisture can pass through gaps in decking surface, collect, and/or drain into one or more drains made of PVC, stainless steal, copper, etc. (e.g., drain 154).

Figure 11:
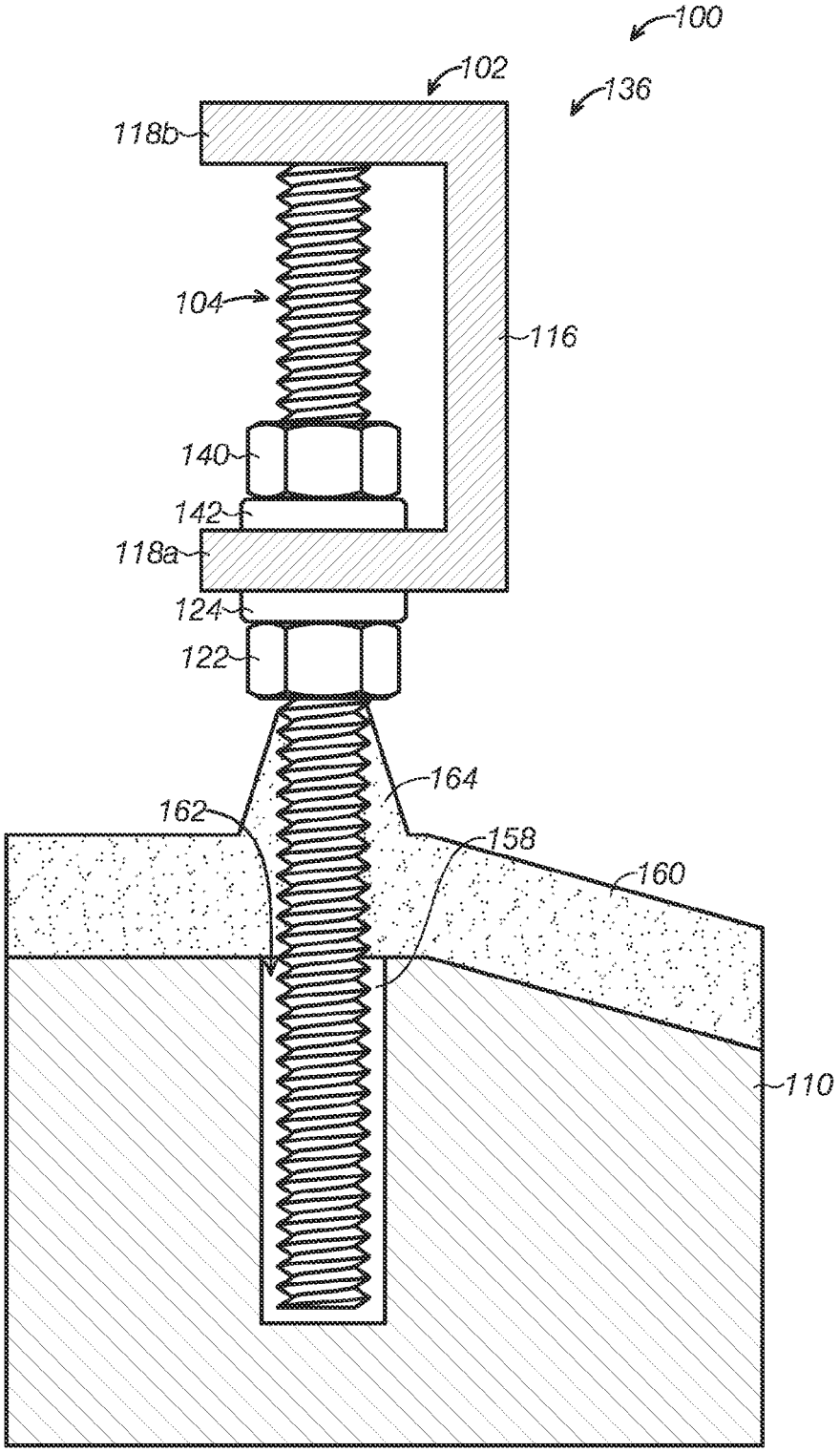
FIG. 11 is a cross-sectional view of the first example of a joist subframing system shown in FIG. 1 depicting the elongate frame member in the second example configuration with a second example underlying waterproofing system.
Figure 12:
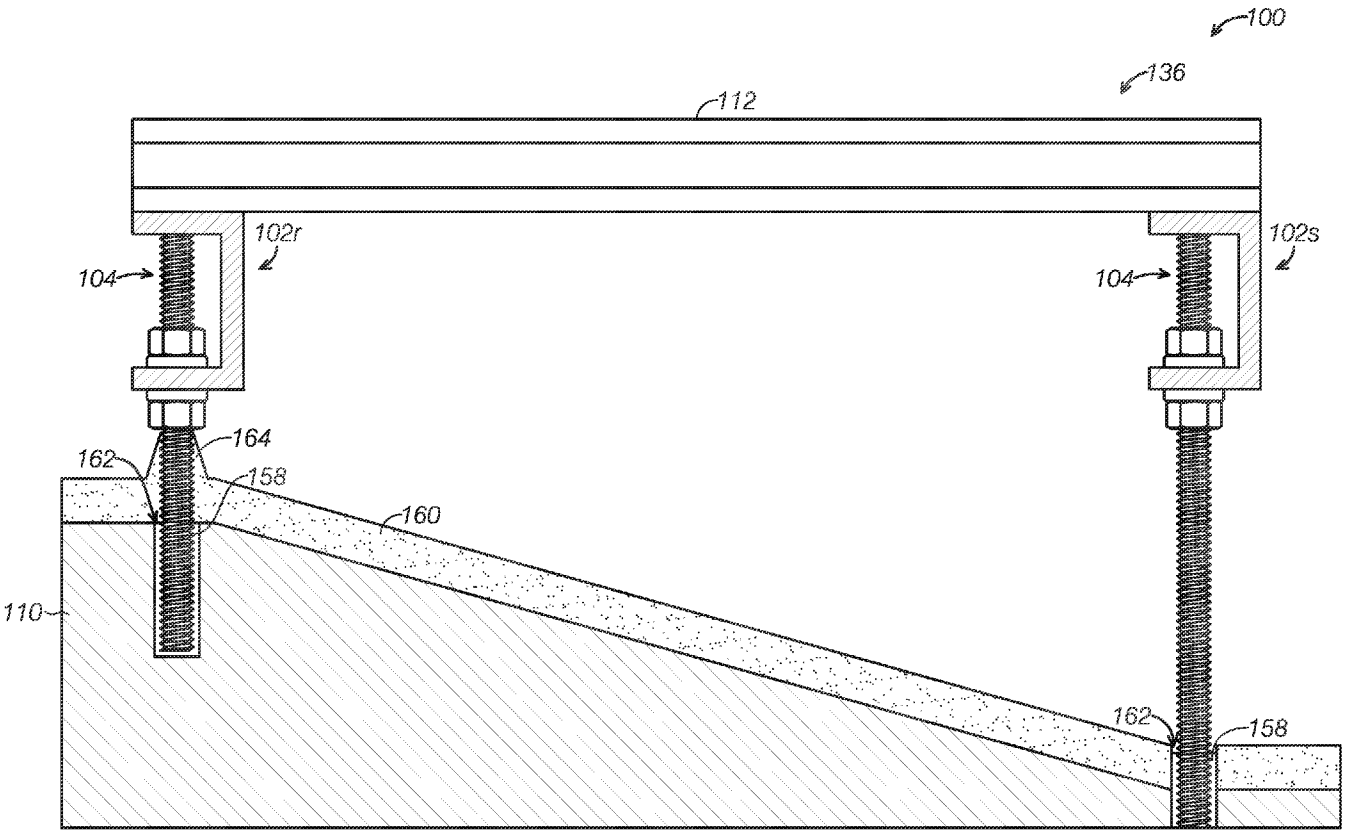
FIG. 12 is a cross-sectional view of the first example of a joist subframing system shown in FIG. 1 depicting the elongate frame member in the second example configuration with a second example underlying waterproofing system.

FIGS. 11 and 12 show an alternate association of joist system 100 with underlying surface. In this example, support members 104 are inserted into holes 158 in ground surface 110. In other words, the ground surface includes a plurality of receiving holes that are configured to receive a bottom end of one of the support members. Further, in this example, support member 104 excludes a bolt head. A water proofing layer 160 is disposed over the ground surface. Further, water proofing layer 160 covers an opening 162 of hole 158 and encompasses a lower portion of support member 104 (i.e., a portion of support member 104 that is below securing member 122) via a water proof boot 164. The water proof boot forms a water-tight seal around a circumference of the lower end of the support member.

In the depicted example shown in FIGS. 11 and 12, elongate frame members 102 are in configuration/orientation 136 (shown in FIG. 6 and described above). Accordingly, one of the side walls supports overlying surface members 112. It will be appreciated that in alternate examples the elongate members can instead be in configuration/orientation 136 (shown in FIG. 6 and described above). Further, in this example, overlying surface members 112 comprise a deck surface.

Similarly to the example shown in FIG. 10, the example shown in FIG. 12 shows overlying surface members 112 having a level configuration over an inclined ground surface 110. In order to create the level overtone surface, an elongate frame member 102*r* is fixed/secured at a shorter height over a higher point in the surface and an elongate frame member 102*r* is fixed/secured at a higher height at a lower point in the surface. It will be appreciated that more elongate members fixed at level heights corresponding to their location on the inclined surface can be used to support the overlying surface members.

In one specific example for FIG. 12, the joist system is attached to vertical ⅜ SS all threads by use of ⅜ nuts and lock washers anchored with epoxy/adhesive (e.g., Simpson Strong-Tie®, PL Premium®, etc.) into substrates such as concrete by drilling 2" deep holes. Once the joist system is attached and adjusted to a level height, the overlying surface members (e.g., Resysta®, Trex®, Timber Tech®, Fiberon®, Tile and Stone, etc.) can be attached. Concrete slabs with a waterproofing membrane (e.g., Dexotex®, Semco®, Tremco®, Shluter®, etc.) applied on a top of the ground surface can be re-waterproofed using waterproofing boots (e.g., vinyl, other water proofing material, etc.). Alternatively, the waterproofing layer can exclude the use of waterproofing boots left when used over surfaces like slab on grade. In this example, water can pass through the gaps in finish surface and be directed to area drains below.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. A joist subframe system, comprising:

a plurality of vertically arranged support members having a plurality of adjustable height securing members, each of the plurality of adjustable height securing members coupled with one of the plurality of support members to be in a fixed position on the support member; and a plurality of horizontally arranged elongate frame members configured to support one or more overlying surface members, each of the plurality of elongate frame members are further arranged in a generally parallel configuration relative to others of the plurality of elongate frame members, each of the plurality of elongate frame members having:

an elongate body with at least one horizontal wall, and one or more support member attachment mechanisms each configured to couple one of the plurality of support members to the elongate body, wherein the one or more support member attachment mechanisms comprise one or more through holes in the at least one horizontal wall of the elongate body, one of the plurality of support members being inserted through each of the one or more through holes.

2. The joist subframe system of claim 1, wherein each of the plurality of adjustable height securing members are selectively tightenable and loosenable to one of the plurality of support members for adjustable coupling to the support member and to releasably fix a position of the support member to one of the plurality of elongate frame members.

3. The joist subframe system of claim 1, further comprising a plurality of foot members, each of the plurality of foot members abutted to a bottom end of one of the plurality of the support members and configured to cushion the bottom end of the support member against an underlying surface.

4. The joist subframe system of claim 1, further comprising an underlying surface, the underlying surface comprising a plurality of receiving holes therein, each of the plurality of receiving holes configured to receive a bottom end of one of the plurality of support members.

5. The joist subframe system of claim 4, further comprising a water proofing layer over the underlying surface and a plurality of water proofing boots, each of the plurality of water proofing boots forming a water tight seal around a circumference of one of the plurality of support members.

6. The joist subframe system of claim 1, wherein the elongate body further comprises at least one vertical wall, and wherein the joist subframe system further comprises a plurality of horizontally arranged elongate fastening members, each of the plurality of fastening members having a first end and a second end, the first end being attached to the at least one vertical wall of a first elongate frame member and the second end being attached to the at least one vertical wall of a second elongate frame member, the first elongate frame member being adjacent to the second elongate frame member.

7. The joist subframe system of claim 1, wherein the elongate body comprises a "C" channel joist.

8. The joist subframe system of claim 7, wherein the "C" channel joist is oriented such that the at least one horizontal wall is a central top wall with two vertical side walls, each of the plurality of support members being attached to the central top wall.

9. The joist subframe system of claim 7, wherein the elongate body further comprises at least one vertical wall, and wherein the "C" channel joist is oriented such that the at least one vertical wall is a central vertical wall with a horizontal top wall and a horizontal bottom wall, each of the plurality of support members being attached to at least the horizontal bottom wall.

10. The joist subframe system of claim 1, wherein each of the plurality of support members is a threaded member and each of the securing members is complimentarily configured to the threaded member.

11. The joist subframe system of claim 1, wherein the plurality of adjustable height securing members comprises a plurality of top securing members and a plurality of bottom securing members, each of the plurality top securing members being attached to one of the plurality of support members on a top side of the at least one horizontal wall and being abutted to a top side of the at least one horizontal wall, each of the plurality of bottom securing members being attached to one of the plurality of support members on a bottom side of the at least one horizontal wall and being abutted to a bottom side of the at least one horizontal wall.

12. The joist subframe system of claim 1, further comprising a plurality of elongate capping members, each of the plurality of elongate capping members configured to attach to ends of the elongate frame members, the plurality of elongate capping members being substantially perpendicular relative to the plurality of elongate frame members.

13. A joist subframe system, comprising:

a plurality of vertically arranged support members having a plurality of adjustable height securing members, each of the plurality of adjustable height securing members coupled with one of the plurality of support members and being selectively tightenable and loosenable to releasably be in a fixed position on the support member;

a plurality of horizontally arranged elongate frame members configured to support one or more overlying surface members, each of the plurality elongate frame members being further arranged in a substantially parallel configuration relative to others of the plurality of elongate frame members, each of the plurality of elongate frame members having:

an elongate body with at least one horizontal wall and at least one vertical wall, and one or more support member attachment mechanisms each configured to couple one of the plurality of support members to the elongate body; and a plurality of horizontally arranged elongate fastening members, each of the plurality of fastening members having a first end and a second end, the first end being attached to the at least one vertical wall of a first elongate frame member and the second end being attached to the at least one vertical wall of a second elongate frame member, the first elongate frame member being adjacent to the second elongate frame member; and an underlying surface having a plurality of receiving holes therein and a water proofing layer over the underlying surface, each of the plurality of receiving holes configured to receive a bottom end of one of the plurality of support members, the water proofing layer having a plurality of water proofing boots, each of the plurality of water proofing boots forming a water tight seal around a circumference of one of the plurality of support members.

14. The joist frame system of claim 13, further comprising a plurality of foot members, each of the plurality of foot members abutted to a bottom end of one of the plurality of the support members and configured to cushion the bottom end of the support member against an underlying surface.

15. The joist frame system of claim 13, wherein the elongate body comprises a "C" channel joist oriented such that the at least one horizontal wall is a central top wall with two vertical side wall, each of the plurality of support members being attached to the central top wall.

16. The joist frame system of claim 13, wherein the elongate body comprises a "C" channel joist oriented such that the at least one vertical wall is a central vertical side wall with a horizontal top wall and a horizontal bottom wall, each of the plurality of support members being attached to at least the horizontal bottom wall.

17. The joist frame system of claim 13, wherein the one or more support member attachment mechanisms is one or more through holes in the at least one horizontal wall of the elongate body, one of the plurality of support members being inserted through each of the one or more through holes, and wherein the plurality of adjustable height securing members comprises a plurality of top securing members and a plurality of bottom securing members, each of the plurality of top securing members being attached to one of the plurality of support members on a top side of the at least one horizontal wall and being abutted to the top side of the at least one horizontal wall, each of the plurality bottom securing members being attached to one of the plurality of support members on a bottom side of the wall and being abutted to the bottom side of the wall.

18. A joist subframe system, comprising:

a plurality of vertically arranged support members having a plurality of adjustable height securing members, each of the plurality of adjustable height securing members coupled with one of the plurality of support members and being selectively tightenable and loosenable to releasably be in a fixed position on the support member;

a plurality of horizontally arranged elongate frame members configured to support one or more overlying surface members, each of the plurality elongate frame members being further arranged in a substantially parallel configuration relative to others of the plurality of elongate frame members, each of the plurality of elongate frame members having:

an elongate body with at least one horizontal wall and at least one vertical wall, and one or more horizontal wall through holes, one of the plurality of support members being inserted through each of the one or more through holes, and one or more vertical wall through holes; and a plurality of horizontally arranged elongate fastening members, each of the plurality of fastening members having a first end and a second end, the first end being inserted through one of the one or more vertical wall through holes for attachment to the at least one vertical wall of a first elongate frame member and the second end being inserted through one of the one or more vertical wall through holes for attachment to the at least one side wall of a second elongate frame member, the first elongate from member being adjacent to the second elongate frame member, wherein the plurality of adjustable height securing members comprises a plurality of top securing members and a plurality of bottom securing members, each of the plurality of top securing members being attached to one of the plurality of support members on a top side of the at least one horizontal wall and being abutted to the top side of the at least one horizontal wall, each of the plurality bottom securing members being attached to one of the plurality of support members on a bottom side of the wall and being abutted to the bottom side of the wall.

* * * * *